US005885659A

United States Patent [19]

Takahashi et al.

[11] Patent Number: 5,885,659

[45] Date of Patent: Mar. 23, 1999

[54] CURTAIN COATING COMMENCING/ TERMINATING APPARATUS AND THE COATING PROCESS USING THE SAME

[75] Inventors: Shunsuke Takahashi; Yusuke Kawai, both of Tokyo, Japan

[73] Assignee: Mitsubishi Paper Mills Limited, Japan

[21] Appl. No.: 909,076

[22] Filed: Aug. 14, 1997

[30] Foreign Application Priority Data

Aug. 20, 1996 [JP] Japan ..... 8-218362

[51] Int. Cl.[6] ..... B05D 1/00

[52] U.S. Cl. ..... 427/420; 118/324; 118/325; 118/DIG. 4

[58] Field of Search ..... 118/324, 325, 118/DIG. 4; 427/420

[56] References Cited

U.S. PATENT DOCUMENTS

| | | | |
|---|---|---|---|
| 3,508,947 | 4/1970 | Hughes | 427/420 |
| 3,991,236 | 11/1976 | Fleissner | 427/420 |
| 4,851,268 | 7/1989 | Kozak | 427/420 |
| 4,922,851 | 5/1990 | Morikawa et al. | 118/324 |
| 5,017,408 | 5/1991 | Kozak | 427/420 |
| 5,206,057 | 4/1993 | Finnicum et al. | 427/420 |
| 5,413,818 | 5/1995 | Suga et al. | 427/420 |
| 5,681,389 | 10/1997 | Lobo et al. | 118/DIG. 4 |

FOREIGN PATENT DOCUMENTS 3-94863 4/1991 Japan .

*Primary Examiner*—Laura Edwards
*Attorney, Agent, or Firm*—Finnegan, Henderson, Farabow, Garrett, & Dunner, L.L.P.

[57] ABSTRACT

A curtain coating apparatus and method in which a catch pan is disposed between a curtain head and a web. The catch pan includes a receiver part used when a curtain film liquid is not coated, an upright level difference part and a shelf part having a slope in the direction of the level difference part. The catch pan is moved in the web running direction or in the opposite direction. The curtain film is received in the receiver part after stopping the coating or before starting the coating, and the tip of the shelf part is moved backward or forward from the curtain film in starting or stopping respectively, whereby an excess coated part is not produced when starting and stopping the coating.

5 Claims, 6 Drawing Sheets

CURTAIN COATING COMMENCING/ TERMINATING APPARATUS AND THE COATING PROCESS USING THE SAME

BACKGROUND OF THE INVENTION (1). Field of the Invention

The present invention relates to a curtain coating apparatus for use in coating photographic printing paper, magnetic recording paper, heat-sensitive recording paper, pressure-sensitive recording paper, ink jet image-receiving paper, heat transfer image-receiving paper and pigment-coated paper, specifically to a curtain coating apparatus which inhibits an excess coated part produced in starting and stopping coating, and a coating method.

(2). Description of the Prior Art

A curtain coating apparatus is a coating apparatus of a so-called pre-metered coating type in which metered coating is carried out prior to a coating operation, and unlike a coating process of an after-metered coating system in which metered coating to a prescribed amount is carried out after feeding an excess coating liquid to a web, the liquid composition of the coating liquid does not change with the passage of time, and a coated matter having a stable quality can be obtained over an extended period of time. Further, since multi-coating is possible and the upper limit of the coating speed is high depending on the coating conditions, coated matters can efficiently be obtained.

Thus, because of many advantages of the curtain coating apparatus, it is used in various coating fields such as photographic printing paper, magnetic recording paper, heat-sensitive recording paper, pressure-sensitive paper, ink jet image-receiving paper, heat transfer image-receiving paper and pigment-coated paper.

In general, coating in curtain coating is started by disposing a shielding member between a curtain film which has been formed in advance and a web to capture the whole coating liquid with the shielding member and removing the shielding member to strike the curtain film against the web. The coating is stopped by bringing the shielding member back to a position where it used to be present before starting the coating to shield again the curtain film from the web. As shall be described below in detail, in such operations as starting and stopping the coating, a part (hereinafter referred to as an excess coated part) where an excess coating liquid is fed to the web is formed, wherein the excess coated part passing through a drying zone while the drying is incomplete stains a roll with the coating liquid and makes the coating operation difficult as well as bringing about a serious defect in terms of quality.

The excess coated part in starting the coating is formed in a different step from immediately after stopping the coating. That is, the coating is started by moving and removing the shielding member disposed between the web and the curtain head, wherein the curtain film is cut with the tip of the shielding member, and the end part of the curtain film forms a liquid film thicker than the curtain film by virtue of the surface tension of the coating liquid. When this thick end part strikes against the web, the excess coated part where the coated amount becomes excessive at a coating-starting part is formed.

The excess coated part formed on the web stays in an undried condition in ordinary drying and transfers the excess coating liquid at a part where the web contacts a roll used for transporting the web. Further, a part of the coating liquid transferred on the roll is transferred again to a coated layer on a web surface, or in contrast with this, it disturbs and peels the ordinary coated layer to bring about coating fault. Accordingly, the formation of the excess coated part exerts an adverse effect on the quality of the coated matter. Further, in order to remove the coating liquid which has contaminated the roll, the apparatus has to be stopped, and therefore the production efficiency is obliged to be notably reduced.

On the other hand, the shielding member is inserted into the curtain film in stopping the coating to cut again the curtain film with the tip of the shielding member. After cutting the curtain film with the tip of the shielding member, the curtain film contracts due to the surface tension thereof to become stick-shaped liquid sagging larger than a liquid film thickness, which drops on the web to form the excess coated part. Further, when cutting the curtain film, the coating liquid adheres to the shielding member to become a droplet, which falls on the web to form the excess coated part. Accordingly, the roll is stained with the coating liquid at the excess coated part as is the case with starting the coating. Also in this case, the cleaning work of the roll is inevitably required and results in bringing about a reduction in the production efficiency.

Means for inhibiting the formation of the excess coated part includes a method in which the shield member used in the operations of starting and stopping the coating is brought as close to the web as possible to minimize the excess amount at the excess coated part. While this method is effective, a function of a receiver for receiving some amount of the coating liquid is requested to the shielding member, and therefore a fence having a fixed height is required to be provided at the edge of the shielding member. Accordingly, even if the shielding member is brought close to the web, a point (hereinafter called a curtain film-cutting point) where the curtain film is cut with the tip of the shielding member in order to start or stop the coating becomes high to some extent. On the other hand, in a method of starting and stopping coating used in U.S. Pat. No. 3,508,947, as shown in FIG. 5 of the attached drawings, a preformed curtain film 2, flowing toward a web 3 supported by a roll 4, is intercepted by a deflector 15. The coating liquid forming the curtain film 2 is directed into a receiver 16 by the deflector 15 to stop the coating operation. The coating operation is commenced by rotating the deflector 15 about a pivot axis 18 and keeping the deflector 15 spaced from the curtain film 2, thus allowing the curtain film 2 to flow into contact with the web 3. To prevent air flow from being developed by running movement of the web 3, a wind interceptor (not shown) is set up slightly in front of the coating point.

In this method, starting and stopping of the coating operation are effected by the deflector 15 crossing the curtain film diagonally, but the deflector itself is not required to function as a receiver. However, in order to cause the liquid to fall into the receiver 16 after flowing along the deflector 15, the deflector 15 has to be inclined and a cutting point of the curtain film must be kept a distance from the web 3. As a result, the method requires a distance of several centimeters between a fall-starting point of the film and the web, and therefore does not provide for inhibiting the formation of the excess coated part.

In the methods of starting and stopping curtain film coating described in Japanese Patent Application Laid-Open (through PCT) No. Hei 2-503884 and U.S. Pat. No. 4,851,268, a trapping pan 17 as shown in FIG. 6 is used, and, when coating is commenced, the point of cutting the curtain film 2 may be only a few millimeters above the web 3. However, very slight shaking caused by moving the trapping pan 17 provides a large possibility that the coating liquid received in the trapping pan 17 would be spilled from the trapping pan 17. Actually, it is difficult to cause the function of the receiver to be sufficiently well compatible with having a distance of some millimeters between the cutting-point of the curtain film 2 and the web 3, and as a result, the excess coated part ends up being formed to such an extent that problems remain.

In the method described in Japanese Patent Application Laid-Open (through PCT) No. Hei 2-503884, it would be possible to stop coating without forming an excess coated part by removing the received coating liquid from the trapping pan 17 in advance of stopping the coating operation so as to provide some measure against spilling of the coating liquid from the trapping pan 17.

However, when starting coating, the coating liquid is liable to spill out while moving the trapping pan 17 receiving the coating liquid between the curtain film 2 and the web 3. Therefore, the excess coated part would be formed as well in the method described in Japanese Patent Application Laid-Open (through PCT) No. Hei 2-503884.

That is, in the curtain coating in which a coated layer is formed by causing the curtain film to flow down to strike against the web, it is very difficult to start the coating without forming the excess coated part, and methods therefor have not been present.

SUMMARY OF THE INVENTION

An object of the present invention is to provide a curtain coating apparatus and a coating method for striking a curtain film flowing down from a curtain head against a continuously running web to form a coated layer, wherein an excess coated part formed in starting and stopping the coating is inhibited, and the coating apparatus is not stained to control the generation of a quality defect.

The present invention relates to a curtain coating apparatus in which a catch pan 9 disposed between a curtain head 1 and a web 3 is moved in starting or stopping the coating to receive a curtain film 2 flowing down from the curtain head 1 on the catch pan 9, and the curtain film 2 is struck against the continuously running web 3 to form a coated layer, wherein the catch pan 9 comprises a receiver part 10 directly receiving the curtain film 2 before starting the coating or after stopping the coating and a level difference part 11 which is higher in a web running direction than the bottom face of the receiver part 10 and is equipped with a shelf part 12 following the level difference part 11 in the web running direction.

The present invention relates to the curtain coating apparatus as described above, wherein the above level difference part 11 has a distance (d) of 8 mm or more.

Further, the present invention relates to the curtain coating apparatus as described in any of the above items, wherein the shelf part 12 has an up grade having an angle (β) of 5° or more based on a level position.

The present invention relates to a coating method in which the curtain coating apparatus as described in any of the above items is used, and the curtain film 2 flowing down from the curtain head 1 is struck against the continuously running web 3 to form a coated layer, wherein the catch pan is moved to start or stop the coating.

DETAILED DESCRIPTION OF THE PREFERRED EMBODIMENTS

Figure 1:
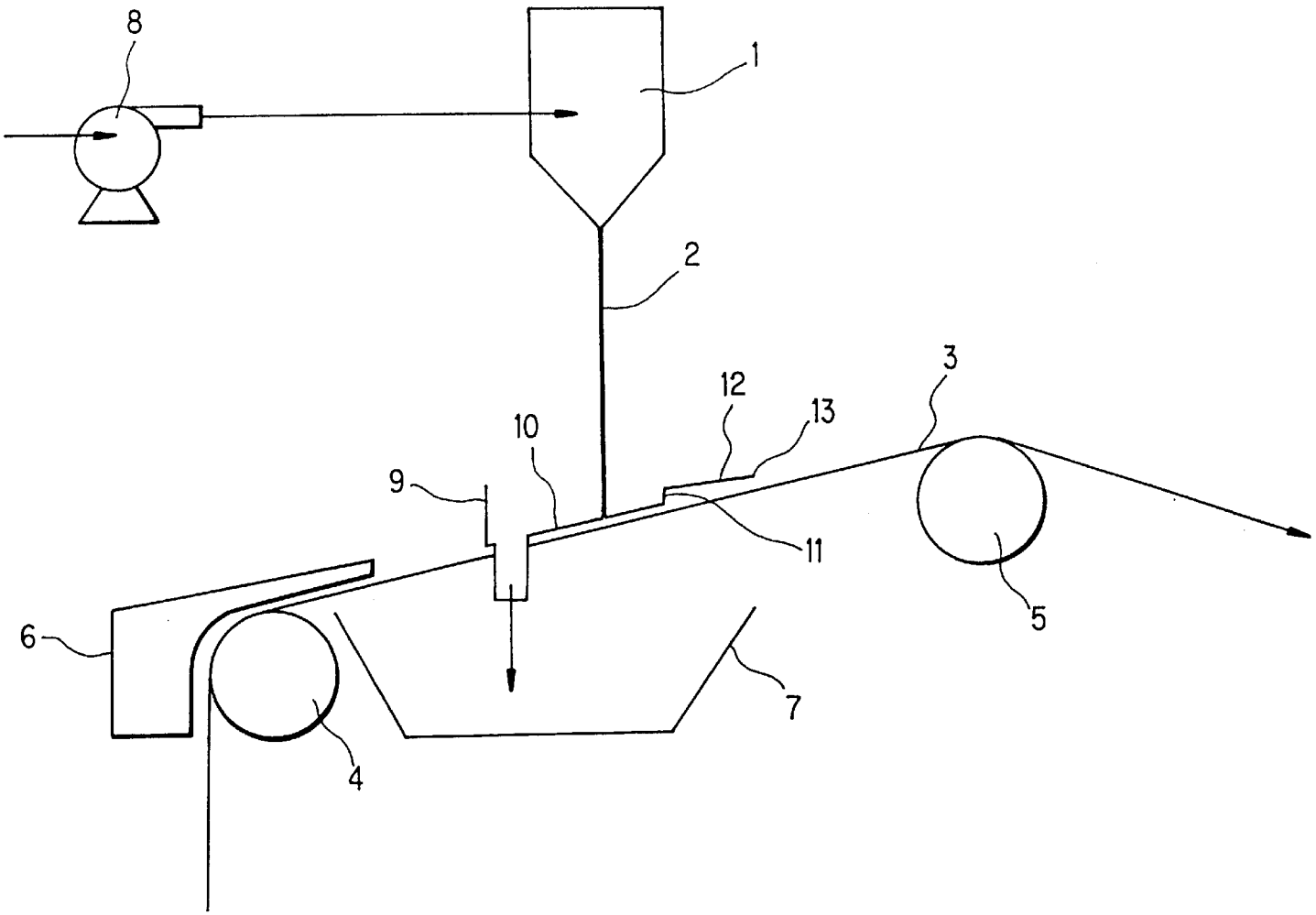
FIG. 1 is a schematic side view showing one example of the present invention.

The present invention relates to the curtain coating apparatus in which the catch pan 9 disposed between the curtain head 1 and the web 3 is moved to receive the curtain film 2 flowing down from the curtain head 1 on the catch pan 9, and the curtain film 2 is struck against the continuously running web 3 to form a coated layer, wherein the catch pan 9 comprises the receiver part 10 directly receiving the curtain film 2 before starting the coating or after stopping the coating and the level difference part 11 which is higher than the bottom face of the receiver part 10 and is equipped with the shelf part 12 following the level difference part 11. This makes it possible to inhibit the excess coated part formed in starting the coating and cause no stain of the coating apparatus, which results in controlling the generation of quality defect.

The preferred embodiments of the present invention shall be explained below in detail with reference to the attached drawings. However, it is a matter of course that the present invention shall not be restricted to the following embodiments and other various embodiments are possible.

Figure 2:
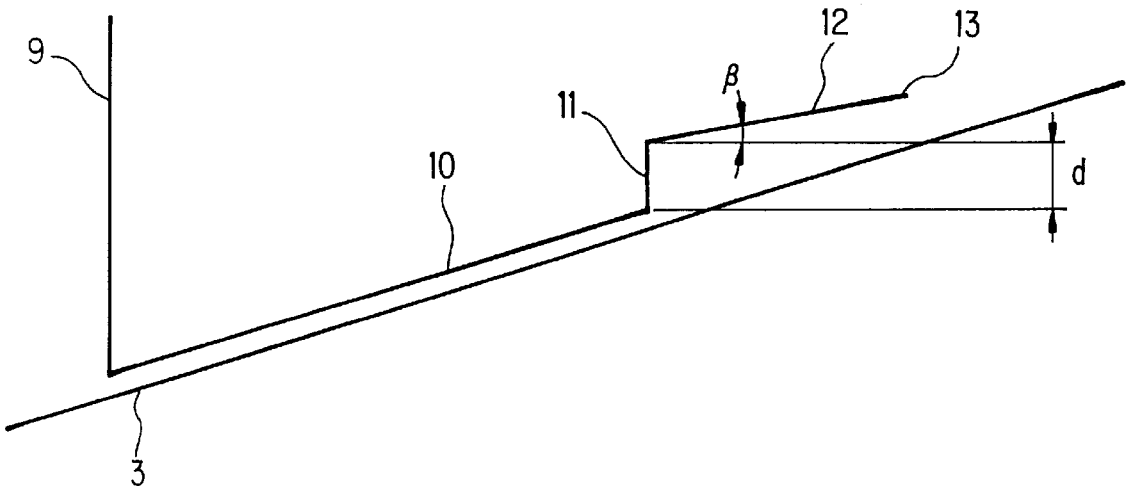
FIG. 2 is a schematic side view of the catch pan used for the coating apparatus of the present invention.
Figure 3A:
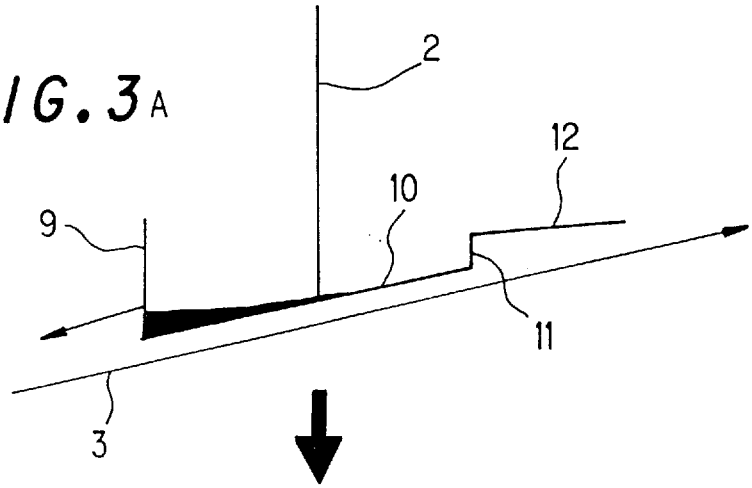
FIGS. 3(A), 3(B) and 3(C) are schematic side views illustrating successive positions of a catch pan of the invention relative to a flowing curtain film.
Figure 3B:
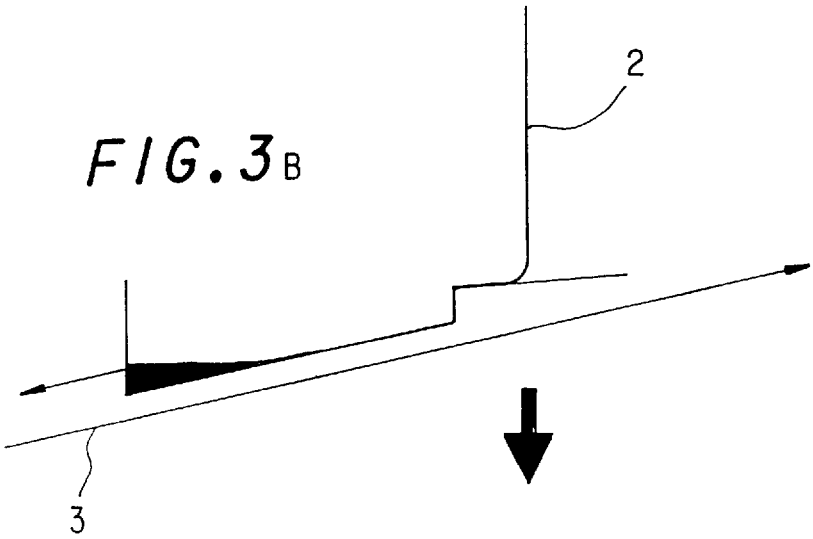
Figure 3C:
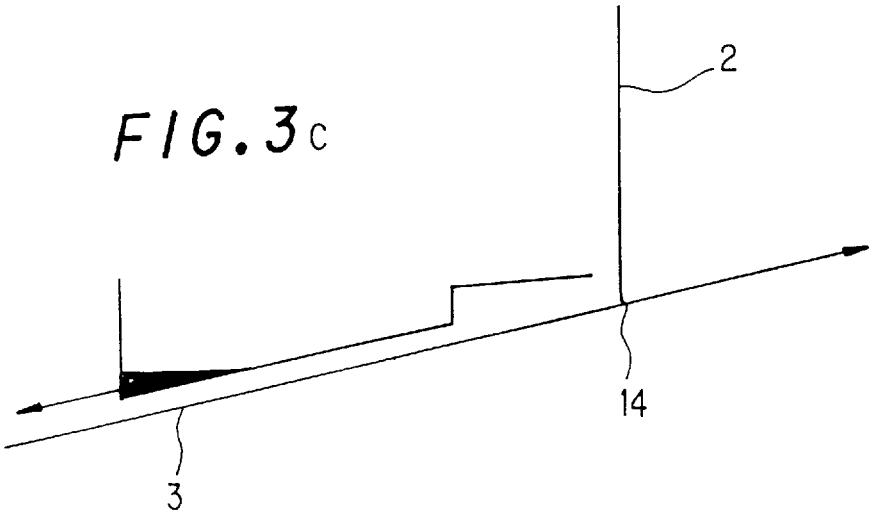
Figure 4:
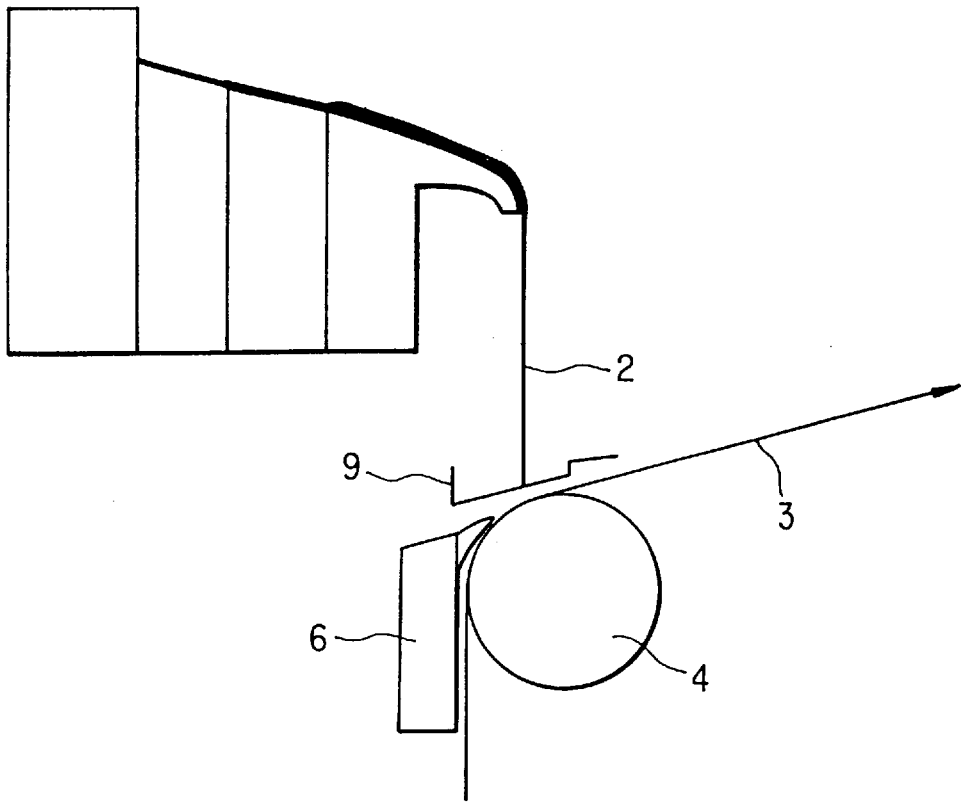
FIG. 4 is a schematic side view of the coating apparatus of the present invention shown in another example.
Figure 5:
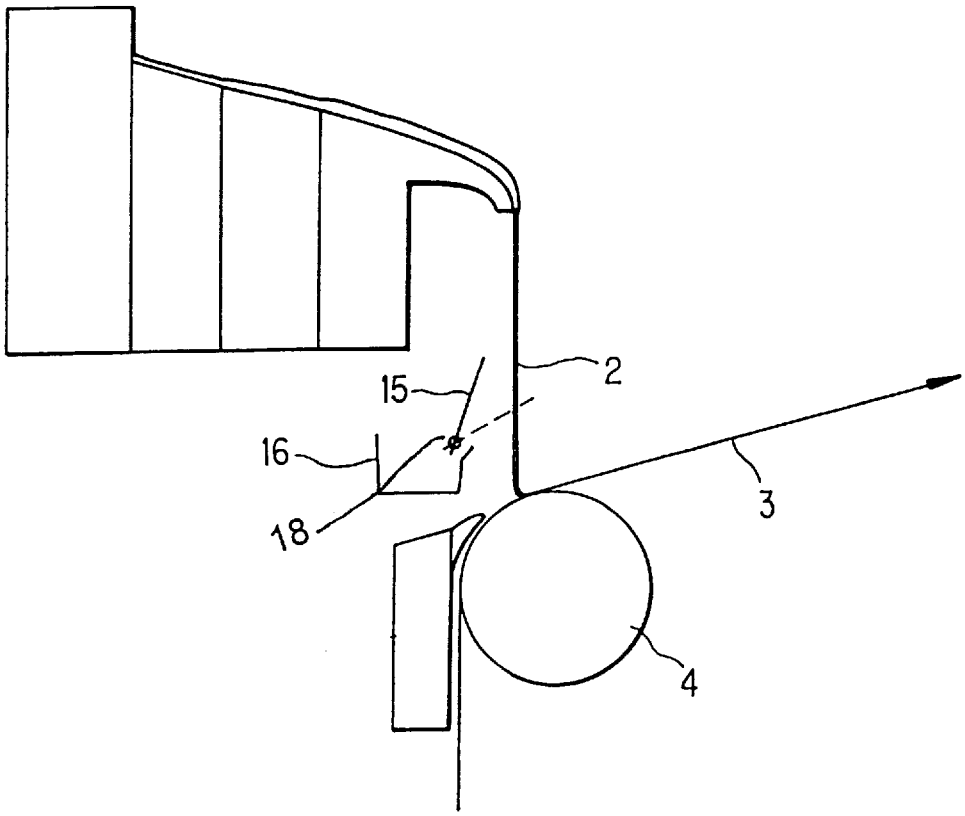
FIG. 5 (PRIOR ART)
FIG. 5 is a schematic side view showing a conventional coating apparatus.
Figure 6:
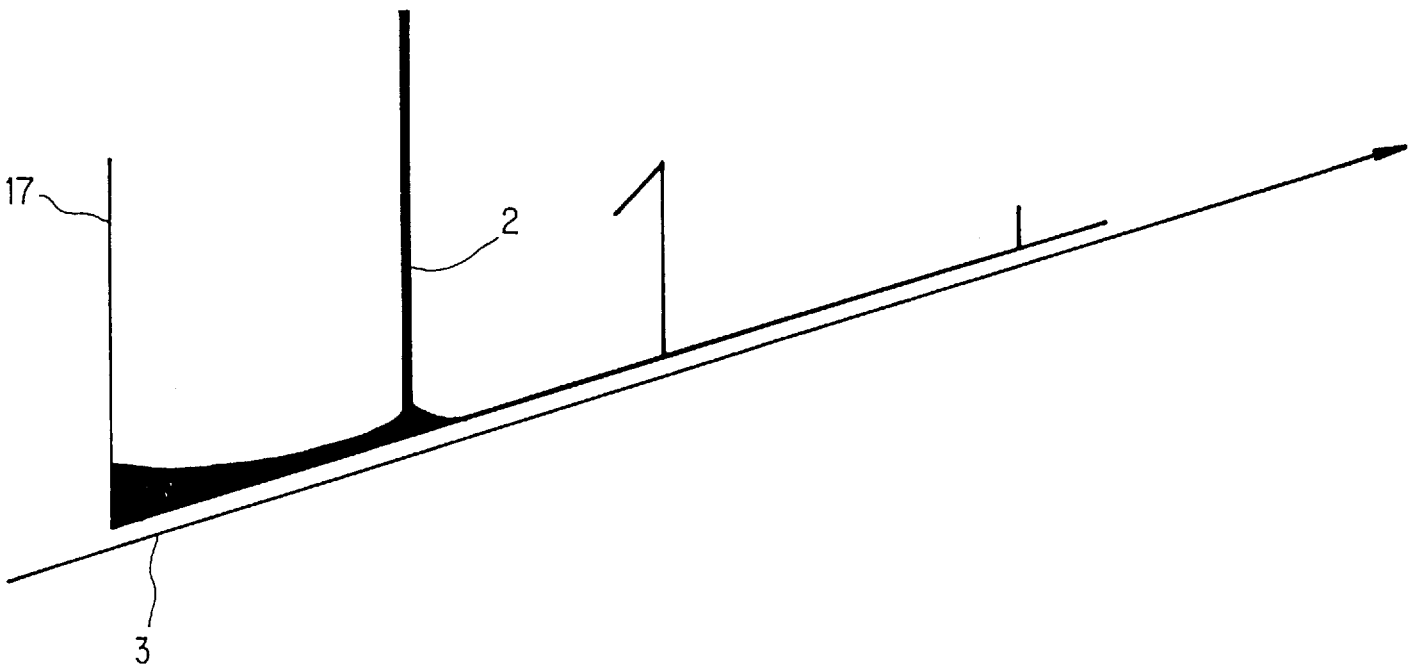
FIG. 6 (PRIOR ART)
FIG. 6 is a schematic side view of a trapping pan used for another conventional coating apparatus.

FIG. 1 is a schematic side view showing the example of the present invention; FIG. 2 is a schematic side view showing the detail of the catch pan used for the coating apparatus of the present invention; FIG. 3 is a schematic side view showing a situation in starting the coating according to the present invention; and FIG. 4 is a schematic side view of the coating apparatus shown in another example.

In the coating apparatus of the present invention shown in FIG. 1, the curtain head 1 is disposed over the web 3 supported by the rolls 4, 5, and the catch pan 9 is disposed between the web 3 and the curtain head 1 in order to receive the coating liquid which flows down from the curtain head 1 to form the curtain film 2. A color pan 7 is disposed under the web 3 in order to receive the coating liquid received in the catch pan 9. The recovered coating liquid is recovered in an unillustrated storage tank. The coating liquid received in the catch pan 9 is recovered in another storage tank in a certain case without returning the storage tank. These operations are carried out depending on the characteristics of the coating liquids. The coating liquid is fed to the curtain head 1 by means of a supplying pump 8.

In the present invention, an air shielding device 6 as shown in FIG. 1 is sometimes disposed in the vicinity of a part [hereinafter referred to as a dynamic contact line 14 (FIG. 3)] where the curtain film 2 falls down to contact the web 3 in order to shield air flow accompanied by the web 3 so that the curtain film 2 reaches the web 3 without being disturbed by air current around the curtain film. Further, such constitution is taken in a certain case that the roll 4 shown in FIG. 1 is positioned in a front upper stream (inverse direction to a web running direction) in the extreme vicinity of the coated part, and the web 3 is turned to a different direction by the roll 4 to minimize the influence of air accompanied by the web 3 to the coated part.

The catch pan used for the coating apparatus of the present invention has a typical shape as shown in FIG. 2 and is required at least to have the receiver part 10 directly receiving the curtain film 2 before starting the coating, have the level difference part 11 which is positioned at the upper part than the bottom face of the receiver part 10 and be equipped with the shelf part 12 in the level difference part 11. That is, the receiver part 10 is necessary for receiving the coating liquid forming the curtain film 2 and preventing the coating liquid from unnecessarily flowing out of the pan 9, and the level difference 11 is important for once cutting the curtain film 2 to isolate the curtain film 2 from the coating liquid received in the catch pan 9 and preventing the coating liquid from flowing backward to a part where the curtain film flows down. The shelf part 12 is needed for forming a stable curtain-falling part without exerting an unsteady force on the isolated curtain film 2.

The shelf part 12 of the catch pan 9 used in the present invention has to have an upper grade than a level position. That is, the shelf part 12 has a grade in order to provide the receiver part 10 with a function to recover the coating liquid forming the curtain film 2 in the receiver part 10. If this grade is not provided, the coating liquid which forms the curtain film 2 falling on the shelf part 12 drops on the web 3 in a certain case to form the excess coated part. Further, the grade of the shelf part 12 has preferably an angle (β) of 5° or more based on a level position. As described previously, if the angle (β) is 5° or more, the coating liquid which forms the curtain film 2 falling on the shelf part 12 is recovered in the receiver part 10. However, if the angle is less than 5°, the coating liquid can not completely be recovered in the receiver part 10 in a certain case due to shock caused by moving the catch pan.

The level difference part 11 of the catch pan 9 used in the present invention has preferably a distance (d) of 8 mm or more. If the distance (d) is less than 8 mm, the coating liquid received in the receiver part 10 flows backward to the shelf part 12 over the level difference part 11. When the pan moves quickly, strong shock is exerted, and the coating liquid flows out of the catch pan from an edge part 13 and spills on the web 3 to form the excess coated part in a certain case.

The length of the shelf part 12 of the catch pan 9 used in the present invention shall not specifically be restricted, and ten and some mm are enough, but in order to carry out more stably the operations of starting and stopping the coating, it may be longer than 10 and some mm. Usually, it is preferably some ten mm. That is, as described previously, the shelf part 12 is needed for forming the stable curtain-falling part without exerting an unsteady force on the curtain film 2. Slight curtain swinging is caused by shock produced when once cutting the curtain at the shelf part 11, and an instable condition of the curtain film is brought about. When the horizontal length of the shelf length is as extremely short as some mm, this curtain film 2 strikes against the web 3 in an instable condition to produce the excess coated part in a certain case.

In the present invention, the coating is started according to the steps shown in FIG. 3 (A→B→C). After the running speed of the web 3 reaches the prescribed value, the position of the catch pan 9 is moved, and the curtain film 2 is contacted with the continuously running web 3 and coated on the web 3. In the case where the web 3 is broken to interrupt the coating, the coating liquid is recovered in the color pan 7 (FIG. 1). The coating liquid recovered in the color pan 7 is recovered in another storage tank in some cases without returning to the storage tank.

The steps of starting the coating in the present invention shall be explained in order. First, the starting step is initiated from a coating stopping condition. As shown in FIG. 3(A) the curtain film 2 falls in the receiver part 10 of the catch pan 9 in the coating stopping condition and no liquid passes to the web. In the second step of starting the coating, the catch pan 9 is moved, and the curtain is once cut by the uppermost part of the level difference part 11. The liquid constituting the curtain film before the curtain film is cut, is recovered by the receiver part 10, and the film after cutting is also recovered in the receiver part 10 on account of the slant of the shelf part 12. In the third step, the shelf part 12 is moved under the lowermost part of the curtain film 2 while forming a solid-liquid interface as shown in FIG. 3(B). In the fourth step, the trailing edge of the shelf part 12 becomes spaced from the curtain film 2, which strikes against the web 3 to complete starting the coating as shown in FIG. 3(C). The curtain coating apparatus of the present invention makes it possible to lower a height for cutting the curtain film 2 by the catch pan 9 to some mm, and therefore the excess coated part is not formed. Further, the liquid in the receiver part 10 is prevented from flowing backward to the shelf part 12 by the level difference part 11 and prevented from spilling due to movement of the catch pan 9. Since the shelf part 12 has a grade, the liquid on the shelf part 12 is recovered as well in the receiver part 10 and does not spills out of the catch pan 9, and therefore the excess coated part is not formed.

In the present invention, the action described above is a base, and as shown in FIG. 3(A), the catch pan 9 in stopping the coating has to be in a position where the curtain film 2 flows down directly in the receiver part 10. In order to once cut the curtain film 2 by the level difference part 11 to form a uniform and stable curtain-falling part at shelf part 12, and inhibit the formation of the excess coated part, the curtain film 2 has to flow down in the receiver part 10 in the first step in starting the coating.

In the present invention, when moving the catch pan 9 in order to start and stop the coating, a height at which the curtain film is cut by the tip of the shelf part 12, that is, a distance between the curtain film-cutting point and the web exerts influence on the formed amount of the excess coated part as described previously and therefore is preferably 0 mm if possible. However, the distance shall not specifically be restricted as long as it is small and exerts no influence on the formation of the excess coated part. Results obtained by intensive investigations made by the present inventors have shown that the distance falls in a preferred range of about 20 mm or less.

The curtain head 1 in the curtain coating apparatus and the coating method according to the present invention shall not specifically be restricted, and the effect to inhibit the formation of the excess coated part is revealed to all curtain heads at such a slot type as shown in FIG. 1 and a slide type as shown in FIG. 4. In the present invention, with respect to a contact part of the web 3 with the curtain film 2, various coated parts can be applied, and the effect to inhibit the formation of the excess coated part is displayed even on the web supported on the roll 4 as shown in FIG. 4 as well as the web supported between the rolls 4, 5 as shown in FIG. 1. In addition, when the curtain film 2 is as wide as exceeding the width of the web 3 and the coated part exists over the whole width in the lateral direction of the web, or also when the curtain film is narrower than the width of the web and is not coated on both ends in the lateral direction of the web, the effect to inhibit the formation of the excess coated part is exhibited as well.

In the case where the web 3 obliquely runs downward as well as in the case where the web 3 obliquely runs upward and the catch pan is set so that the receiver part 10, the level difference part 11, the shelf part 12 and the edge part 13 are disposed in this order toward a downstream in a running direction of the web 3 as shown in FIGS. 1 and 4, the effect of inhibiting the formation of the excess coated part is displayed by setting direction of the receiving part 10 against to the shelf part 12 inversely to the case where the web 3 obliquely runs upward. In the case where the web 3 horizontally runs, the direction of the catch pan 9 shall not be restricted.

A speed at which the catch pan moves while the shelf part 12 passes under the curtain film 2 in starting the coating according to the present invention is 12 m/min to 1200 m/min since a good effect for starting the coating is liable to be obtained at this speed.

Next, the coating liquid and the web used in the present invention shall be explained. Further, the coating speed in the coating and the fed amount of the coating liquid shall be explained as well.

In the present invention, photographic emulsions obtained by dispersing silver halide in a gelatin aqueous solution, magnetic substance coating liquids obtained by dispersing magnetic substance particles in water or an organic solvent, heat-sensitive color coupler-coating liquids obtained by dispersing color couplers and developers, pressure-sensitive color coupler-coating liquids obtained by dispersing microcapsules containing color couplers or developers, and pigment-coated paper-coating liquids obtained by dispersing inorganic or organic pigments can be used as the coating liquid regardless of solid content concentrations without having any restrictions as long as they are coating liquids capable of being applied by curtain coating. With respect to the viscosities of the coating liquids, preferred are the coating liquids having a B type viscosity falling in a range of 10 to 300 cps.

The web used in the present invention includes woodfree paper, mechanical paper, groundwood paper, machine-coated paper, art paper, cast-coated paper, synthetic paper, resin-coated paper, plastic film, metal plate, rubber plate, and cloths woven from natural or synthetic fibers.

The coating speed shall not specifically reduce the effects of the present invention as long as it resides in a range of a condition where ordinary curtain coating can be carried out and falls preferably in a range of 15 m/min to 1500 m/min. On the other hand, the amount of the liquid coated on the web in terms of unit time and unit width, that is, the flow amount shall not specifically be restricted as long as it falls in a range of ordinary curtain coating conditions. In general, it falls preferably in a range of 4 L/min to 20 L/min in terms of a flow amount per width of 1 m.

The use of the coating apparatus and the coating method according to the present invention makes it possible to inhibit the excess coated part formed in starting the coating and form the tip part for starting the coating which does not stain the coating apparatus, and therefore the coated matters having no quality defects can be obtained.

EXAMPLES

Examples shall be given below in order to make the present invention clearer. Parts used in the examples mean parts by weight. Unless otherwise described, the concentrations show concentrations of solid matters in terms of % by weight, and the coated amounts show coated amounts after drying.

Example 1

[Production process for a coating liquid]

<Capsule dispersion>

Two hundred parts of high boiling oil (KMC-113 manufactured by Kureha Chemical Ind. Co., Ltd.) dissolving 5 parts of crystal violet lactone (CVL) were added to 250 parts of a 5% styrene-maleic anhydride copolymer aqueous solution (pH 5.0) to prepare an emulsion having an average particle diameter of 6 μm.

Next, 20 parts of a 40% melamine-formalin initial condensation product aqueous solution (Sumilet Resin manufactured by Sumitomo Chemical Ind. Co., Ltd.) were added to the emulsion described above, and the temperature was elevated to 75° C. to continue the reaction for 2 hours. Then, pH was adjusted to 9.0 by a 20% sodium hydroxide aqueous solution, and the solution was cooled down to room temperatures to obtain a microcapsule dispersion of 40%.

<Coating liquid>

The microcapsule dispersion thus obtained was added in the following composition, and water was further added to adjust the solid concentration to 33%, whereby a coating solution was obtained.

| | |
|---|---|
| 40% microcapsule dispersion | 100 parts |
| wheat starch (average particle diameter: 20 μm) | 50 parts |
| 48% carboxy-modified styrene-butadiene copolymer latex | 20 parts |

The catch pan shown in FIG. 2 was prepared, wherein the values of d and β were set to 8 mm and 7°, respectively, and the length of the shelf part was set to 30 mm, and then the coating liquid thus prepared was used to start coating of a pressure-sensitive recording paper on a wood free paper having a weight of 40 g/m$^2$ at a coating speed of 1000 m/min to a coated amount of 3.5 g/m$^2$, wherein the moving speed of the catch pan was controlled to 60 m/min, and a distance between a point where the catch pan cut the curtain film and the web was set to 10 mm.

Example 2

Five minutes later since starting the coating in Example 1, the coating was stopped using the catch pan used in Example 1 so that the moving speed of the catch pan was controlled to 60 m/min, and a distance between a point where the catch pan cut the curtain film and the web was set to 10 mm.

Example 3

The coating was started in the same manner as in Example 1, except that the values of d and β shown in FIG. 2 were set to 10 mm and 7°, respectively.

Example 4

The coating was started in the same manner as in Example 1, except that the values of d and β shown in FIG. 2 were set to 20 mm and 7°, respectively.

Example 5

The coating was started in the same manner as in Example 1, except that the values of d and β shown in FIG. 2 were set to 10 mm and 5°, respectively.

Example 6

The coating was started in the same manner as in Example 1, except that the values of d and β shown in FIG. 2 were set to 10 mm and 10°, respectively.

Example 7

The coating was started in the same manner as in Example 1, except that the values of d and β shown in FIG. 2 were set to 10 mm and 15°, respectively.

Comparative Example 1

The coating was started in the same manner as in Example 1, except that the values of d and β shown in FIG. 2 were set to 7 mm and 7°, respectively.

Comparative Example 2

The coating was started in the same manner as in Example 1, except that the values of d and β shown in FIG. 2 were set to 3 mm and 7°, respectively.

Comparative Example 3

The coating was started in the same manner as in Example 1, except that the values of d and β shown in FIG. 2 were set to 0 mm and 7°, respectively.

Comparative Example 4

The coating was started in the same manner as in Example 1, except that the values of d and β shown in FIG. 2 were set to 10 mm and 4°, respectively.

Comparative Example 5

The coating was started in the same manner as in Example 1, except that the values of d and β shown in FIG. 2 were set to 10 mm and 0°, respectively.

Comparative Example 6

The coating was started in the same manner as in Example 1, except that the values of d and β shown in FIG. 2 were set to 0 mm and 15°, respectively.

[Evaluation method for roll stain]

The stain of a paper roll contacted with the coated surface immediately after passing through a drying zone after finishing the coating was evaluated by observing with naked eyes and touching with a hand and classified into the following grades. The allowable level is the grade of ○ or higher.

◎: no stain was observed, and no foreign matters were found by touching with hands ○: slight stain was observed, but no foreign matters were found by touching with hands ○~Δ: slight stain was observed by observing with naked eyes, and foreign matters were slightly felt by touching with a hand but no such irregularities as catching were found Δ: stain was observed, and such irregularities as slightly catching were found by touching with a hand x : considerable stain was observed, and such considerable irregularities as catching were found by touching with a hand

[Blocking evaluation method for coated paper]

The coating-starting part of the rolled coated web and the peeling condition of the web superposed thereon were evaluated as blocking evaluation according to the following grades. The allowable level is the grade of ○ or higher.

○: no sticking observed and easily peeled off

Δ: slight sticking observed and difficult to peel off x: sticking observed and impossible to peel off The evaluation results of the roll stain and the blocking of the coated paper in the examples and the comparative examples are shown in Table 1.

TABLE 1

| | d mm | β ○ | Roll stain | Blocking | Remark |
|---|---|---|---|---|---|
| Example | | | | | |
| 1 | 8 | 7 | ○ | ○ | Start coating |
| 2 | 8 | 7 | ◎ | ○ | Stop coating |
| 3 | 10 | 7 | ◎ | ○ | Start coating |
| 4 | 20 | 7 | ◎ | ○ | Start coating |
| 5 | 10 | 5 | ○ | ○ | Start coating |
| 6 | 10 | 10 | ◎ | ○ | Start coating |
| 7 | 10 | 15 | ◎ | ○ | Start coating |
| Comparative Example | | | | | |
| 1 | 7 | 7 | ○ ~ Δ | ○ | Start coating |
| 2 | 3 | 7 | Δ | Δ | Start coating |
| 3 | 0 | 7 | x | x | Start coating |
| 4 | 10 | 4 | ○ ~ Δ | ○ | Start coating |
| 5 | 10 | 0 | Δ | Δ | Start coating |
| 6 | 0 | 15 | ○ ~ Δ | Δ | Start coating |

The evaluation results as shown in Table 1 were obtained, and it is apparent from the results thus obtained that roll stain and the generation of blocking are not observed in Examples 1 to 7 of the present as compared with Comparative Examples 1 to 6 and stable coating operations are possible.

What is claimed is:

1. A curtain coating apparatus comprising:

a curtain coating head;

means for supporting a uniformly inclined upwardly running web; and a movable catch pan positioned below the curtain head close to the web for movement parallel to the running web, the catch pan having a receiver part to receive a curtain film flowing down from said coating head toward the web before starting the coating or after stopping the coating, a level difference part higher in a web running direction than a bottom face of the receiver part, and a shelf part on the level difference part opposite the receiver part, whereby, before starting a coating operation, the curtain film is received in the receiver part of the catch pan, and movement of the catch pan in one direction causes the bottom of the curtain film to advance from the receiver part, through the level difference part, to the shelf part, and from the shelf part to the running web, and when stopping the coating, movement of the catch pan in a direction opposite to the one direction advances the shelf part into the curtain film until the receiver part is positioned under the curtain film.

2. The curtain coating apparatus as described in claim 1, wherein said level difference part has an upright distance of at least 8 mm.

3. The curtain coating apparatus as described in claim 2, wherein the shelf part is inclined upwardly at an angle of at least 5° from a level reference line.

4. A curtain coating process for applying a curtain film of coating liquid to a continuously running web, comprising the steps of:

orienting the web to run in an upwardly inclined direction, flowing the curtain film of coating liquid downwardly toward the web, positioning a movable catch pan in the path of the flowing curtain film, the catch pan having a receiver part to receive the curtain film, a level difference part higher in a web running direction than a bottom face of the receiver part, and a shelf part on the level difference part opposite the receiver part, receiving the curtain film in the receiver part of the catch pan at the beginning of the curtain coating, moving the catch pan in a direction opposite to the web running direction, starting the coating when the curtain film separates from an end of the shelf part after passing through the level difference part and the shelf part, moving the catch pan in the web running direction to stop the coating, and stopping the coating when the shelf part of the catch pan advances into the curtain film.

5. A curtain coating process for applying a curtain film of coating liquid to a continuously running web, comprising the steps of:

orienting the web to run in an downwardly inclined direction, flowing the curtain film of coating liquid downwardly toward the web, positioning a movable catch pan in the path of the flowing curtain film proximate and parallel to the running web, the catch pan having a receiver part to receive the curtain film, a level difference part higher in a web running direction than a bottom face of the receiver part, and a shelf part on the level difference part opposite the receiver part and having a free end facing in a direction opposite to the web running direction, receiving the curtain film in the receiver part of the catch pan at the beginning of the curtain coating, moving the catch pan in the web running direction to start the coating when the curtain film separates from the free end of the shelf part, moving the catch pan in a direction opposite to the web running direction to stop the coating, and stopping the coating when the curtain film is received in the shelf part of the catch pan.

* * * * *

UNITED STATES PATENT AND TRADEMARK OFFICE

CERTIFICATE OF CORRECTION

PATENT NO. : 5,885,659

DATED : March 23, 1999

INVENTOR(S) : Shunsuke TAKAHASHI et al.

It is certified that error appears in the above-indentified patent and that said Letters Patent is hereby corrected as shown below:

Claim 3, column 10, line 53, after "claim", insert --1 or--.

Signed and Sealed this

Ninth Day of November, 1999

*Attest:*

*Attesting Officer*

Q. TODD DICKINSON

*Acting Commissioner of Patents and Trademarks*